US006050363A

United States Patent [19]

Tu

[11] Patent Number: 6,050,363

[45] Date of Patent: Apr. 18, 2000

[54] MUFFLER

[76] Inventor: Hui-Li Tu, No. 9-23, Tong-Wen Lane, Shin-Cherng Tsuen, Yu-Chyr Hsiang, Nan-Tou Shiann, Taiwan

[21] Appl. No.: 09/262,968

[22] Filed: Mar. 4, 1999

[51] Int. Cl.[7] ..... F01N 1/08

[52] U.S. Cl. ..... 181/264; 181/272

[58] Field of Search ..... 181/264, 272, 181/269, 281, 282

[56] References Cited

U.S. PATENT DOCUMENTS

| | | | |
|---|---|---|---|
| 624,062 | 5/1899 | Matthews | 181/264 |
| 4,574,914 | 3/1986 | Flungger | 181/281 |
| 4,890,691 | 1/1990 | Chinh-ho | 181/264 |

*Primary Examiner*—Khanh Dang
*Attorney, Agent, or Firm*—W. Wayne Liauh

[57] ABSTRACT

A cylindrically shaped muffler for a gas engine with substantially reduced noise. It includes: (a) a cylindrical shell having a shell-bore, an inlet and an outlet; (b) a plurality of first hollow cones suspended within but is supported by the shell-bore, the first hollow cones having their largest diameters smaller than that of the shell-bore with their apexes pointing toward the inlet of the cylindrical shell; (c) a plurality of hollow truncated second cones having their greatest diameters equal to that of the shell-bore in which they are supported in reverse to the first hollow cones and alternate therewith, so as to have their smallest diameter portions pointing toward the outlet of the cylindrical shell; and (d) a circular stopper suspended inside the hollow truncated second cone near its smallest diameter portion in such a manner to create eddy currents in gas flow so as to absorb noise. The first hollow cones are affixed to the shell-bore by a plurality of connection pillars, and the second truncated hollow cones are affixed to the cylindrical shell from outside thereof.

5 Claims, 6 Drawing Sheets

MUFFLER

FIELD OF THE INVENTION

The present invention relates generally to a muffler, and more particularly to a muffler capable of reducing the noise level by the gas eddy current brought about by the exhaust fume entering the air chamber in quantity, thereby resulting in appropriate back pressure so as to propel the gas mixture from the intake manifold into the combustion chamber of the cylinder.

BACKGROUND OF THE INVENTION

The muffler is a very important component part of a motor vehicle. As a result, an improvement on the muffler of the motor vehicle can give an added performance to the motor vehicle. During the operation of an engine, exhaust fume and, noise are produced by the gas explosion taken place in the engine cylinder of the motor vehicle. It is therefore readily apparent that the marketability of the motor vehicle can be greatly enhanced by an improved muffler capable of reducing the noise level of the exhaust fume. In addition, the gas mixture in the intake manifold must be propelled by a pressure source to enter the combustion chamber in which the gas mixture is burned in conjunction with the ignition fire. For this reason, it is necessary that the muffler contains an appropriate return pressure for propelling the fuel mixture into the combustion chamber at the time when the gas explosion has taken place in one cylinder and when the gas explosion has not taken place in another cylinder.

There are several kinds of muffler, which are commonly used in the motor vehicles available in the market place today. These mufflers are described herein after.

As shown in FIG. 1, a prior art muffler 10 is provided in the mid-segment thereof with a gas duct 101. Both gas duct 101 and the muffler 10 are provided with a silencing fiber 102 which is made of a metal or glass fiber material. The gas duct 101 is provided at one end thereof with a gas inlet 103 in communication with the engine, and at other end thereof with a gas outlet 104 for discharging the exhaust fume. The gas duct 101 is further provided in the side wall thereof with a plurality of gas holes 105. When the exhaust fume current produced by the engine is brought into the gas duct 101 of the muffler 10 via the gas inlet 103, the gas noise of the exhaust fume current is alleviated by the silencing effects of the gas holes 105 and the silencing 102. However, it is technically troublesome to provide the muffler 10 and the gas duct 101 with the silencing fiber 102. Moreover, the silencing effect of the silencing fiber 102 is greatly undermined by the fast-moving exhaust fume that is unlikely to move into the silencing fiber 102 via the gas holes 105. As a result, the prior art muffler 10 is not effective in reducing the noise of exhaust fume.

In order to overcome the drawback of the prior art muffler 10 described above, the straight gas duct 101 is modified such that the gas duct 101 is so curved as to enable the exhaust fume to move in a curved path in which the exhaust fume flow is slowed down to an extent that an appropriate back pressure is produced in the gas duct 101, as shown in FIG. 2.

The back pressure serves to propel the fuel mixture from the intake manifold into the combustion chamber at the time when the gas explosion in one of the cylinders has taken place and when the gas explosion in another one of the cylinders has not taken place. However, the technical deficiency of the prior art muffler 10 is not resolved by the curved gas duct 101 in view of the fact that the muffler 10 and the curved gas duct 101 must still be provided therebetween with the silencing fiber 102 for deadening noises of the exhaust fume current.

Now referring to FIG. 3 in which an improved muffler 20 is shown. The muffler 20 is provided at one end thereof with a gas inlet 201 in communication with the engine, and at other end thereof with a gas outlet 202. The muffler 20 is further provided therein with a plurality of air chambers 203 which are in communication with one another by gas ducts 204 that are arranged alternatively and provided with a plurality of gas holes 205. Each air chamber 203 is provided in the wall thereof with a noise-deadening fiber 206. As a result, the noise of the exhaust fume current is progressively reduced as the exhaust fume current moves from one air chamber 203 to another air chamber 203. In addition, the flow of the exhaust fume is also progressively slowed down as the exhaust fume flows from the first air chamber 203A into the second air chamber 203B via the gas duct 204 and the gas holes 205. In light of the alternate arrangement of the gas ducts 204, the flow of the exhaust fume is effectively slowed down such that the duration of the exhaust fume to remain in the air chamber is prolonged. On the one hand, the gas noise of the exhaust fume current is absorbed by the noise-deadening fiber 206. On the other hand, the back pressure in the muffler is increased as a result of the prolonged stay of the exhaust fume in the air chambers. In view of the fact that the stay of the exhaust fume in the air chambers tends to be excessively prolonged, and that the return pressure tends to excessive in intensity, the exhaust fume emission can not be easily attained; in addition, when the intensity of the return pressure in the muffler is greater than normal, the basic of the inlet vacuum of the combustion chamber becomes greater, thereby resulting in the premature ignition timing as well as the inefficient operation of the engine, and more heating of the engine as well as the engine knock.

As shown in FIG. 4, the U.S. Pat. No. 4,574,914 discloses an muffler 30 which has a long flat cross section and are provided at both ends thereof with an inlet 301 and an outlet 302. The muffler 30 is provided therein with three sets of air chambers 40. Each air chamber set 40 is formed of a cup-shaped stop piece 50 and a partition 60. The cup-shaped stop piece 50 is fastened at the upper and the lower edges thereof with the wall of the muffler 30 such that the stop piece 50 is fastened in the air chamber 40, and that the stop piece 50 is contiguous to the inlet 301, and further that the stop piece 50 is provided with two stop walls 501 extending from the center point toward other end. The two stop walls 501 are vertically provided at the tail end thereof with a stop edge 502. The partition 60 is contiguous to the outlet 302 and is separated from the cup-shaped stop piece 50 at an interval. The partition 60 is provided at both ends thereof with an extension wall 601, which is fastened with the wall of the muffler 30.

The partition 60 is provided at the center thereof with a gas hole 602. The air chamber 40 is located between the partition 60 and the cup-shaped stop piece 50. As shown in FIG. 5, when the exhaust fume is released by the engine to enter the muffler 30, the exhaust fume enters the first air chamber 40A via the space between the stop piece 50 and the muffler 30 due to the obstruction of the stop piece 50 of the first air chamber 40A. The exhaust fume circulates in the first air chamber 40A to form a gas eddy current for absorbing the gas noise of the exhaust fume. When the gas in the first air chamber 40A has reached the saturation point, the exhaust fume diffuses via the gas holes 602 of the partition 60 into the muffler 30 such that the exhaust fume is obstructed by the stop piece 50 of the second air chamber 40B, and that the exhaust fume circulates once again. The noise of the exhaust fume is progressively absorbed by the gas eddy currents formed in the subsequent air chambers. The flow of the exhaust fume is prolonged in the air chambers by the stop piece 50 and the partition 60 such that the pressure in the muffler is increased to prevent the entry of atmospheric air into the muffler and that the muffler remains in the state of discharging the exhaust fume at the interval of the gas explosion of each cylinder.

In view of the fact that the stop piece and the partition are of a long piece construction, they can be fastened only in the muffler of a long flat construction. The motor vehicles of different models or makers are provided with the round fastening holes due to more space of trunk, the motor vehicles must be provided with the round muffler.

In addition, the upper and the lower edges of the cup-shaped stop piece are fastened with the wall of the muffler. When the exhaust fume is discharged by the engine to enter the muffler, the volume of exhaust fume entering the first air chamber via the gap between the stop piece and the muffler is limited. As a result, the exhaust fume tends to deposit between the stop piece and the inlet at the time when an excessive amount of exhaust fume is generated by the engines of various horse powers. The exhaust fume emission can not be thus carried out in time.

SUMMARY OF THE INVENTION

It is therefore the primary objective of the present invention to provide an improved round muffler having three sets of air chambers that are provided with a stop portion. Located between the stop portion and the muffler is a gas duct via which the exhaust fume is allowed to enter the air chamber in quantity such,that the exhaust fume is obstructed by the stop portion and the tapered cylinder so as to form a strong gas eddy current for absorbing the gas noise of the exhaust fume. In addition, the pressure of the gas in the gas chamber is so raised as to form a return pressure to facilitate the propelling of the gas mixture from the intake manifold into the cylinder combustion chamber.

It is another objective of the present invention to provide a round muffler which is compatible with the motor vehicles provided with round fastening holes. The round muffler of the present invention can be used in such motor vehicles for reducing the noise and increasing the return pressure.

The foregoing objectives, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
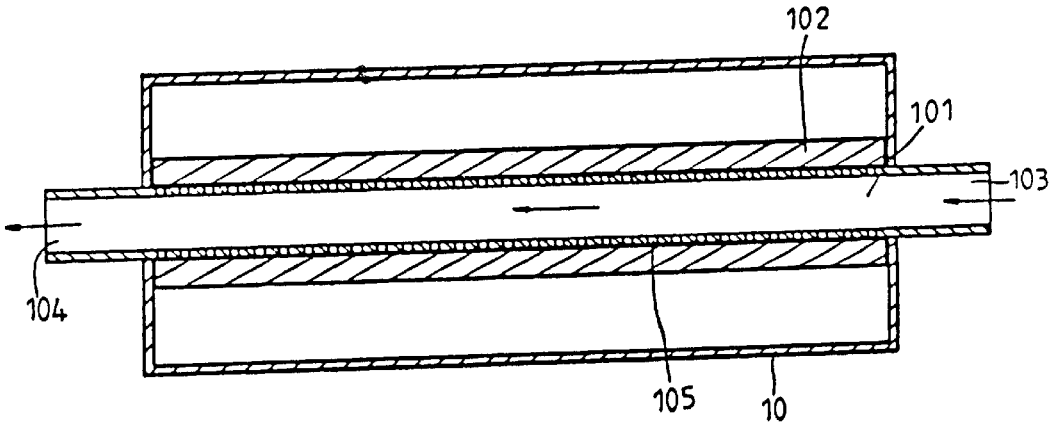
Fig. 1 PRIOR ART
FIG. 1 shows a schematic view of a prior art muffler.
Figure 2:
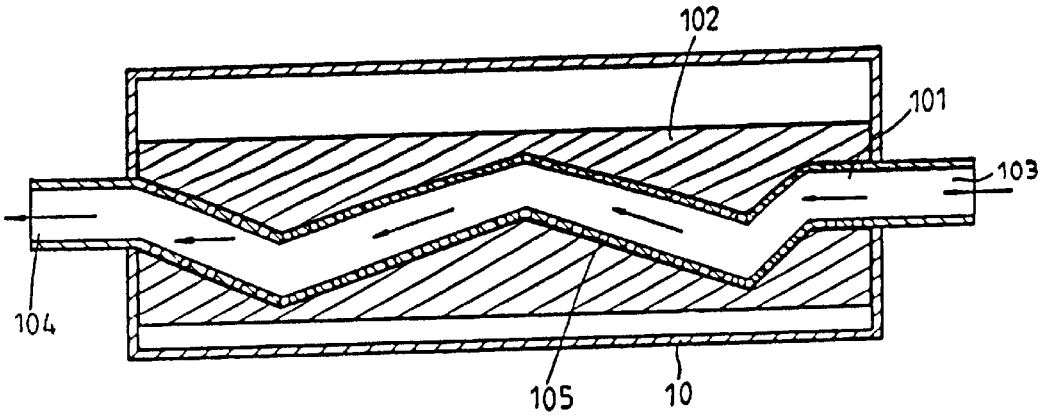
Fig. 2 PRIOR ART
FIG. 2 shows a schematic view of another prior art muffler.
Figure 3:
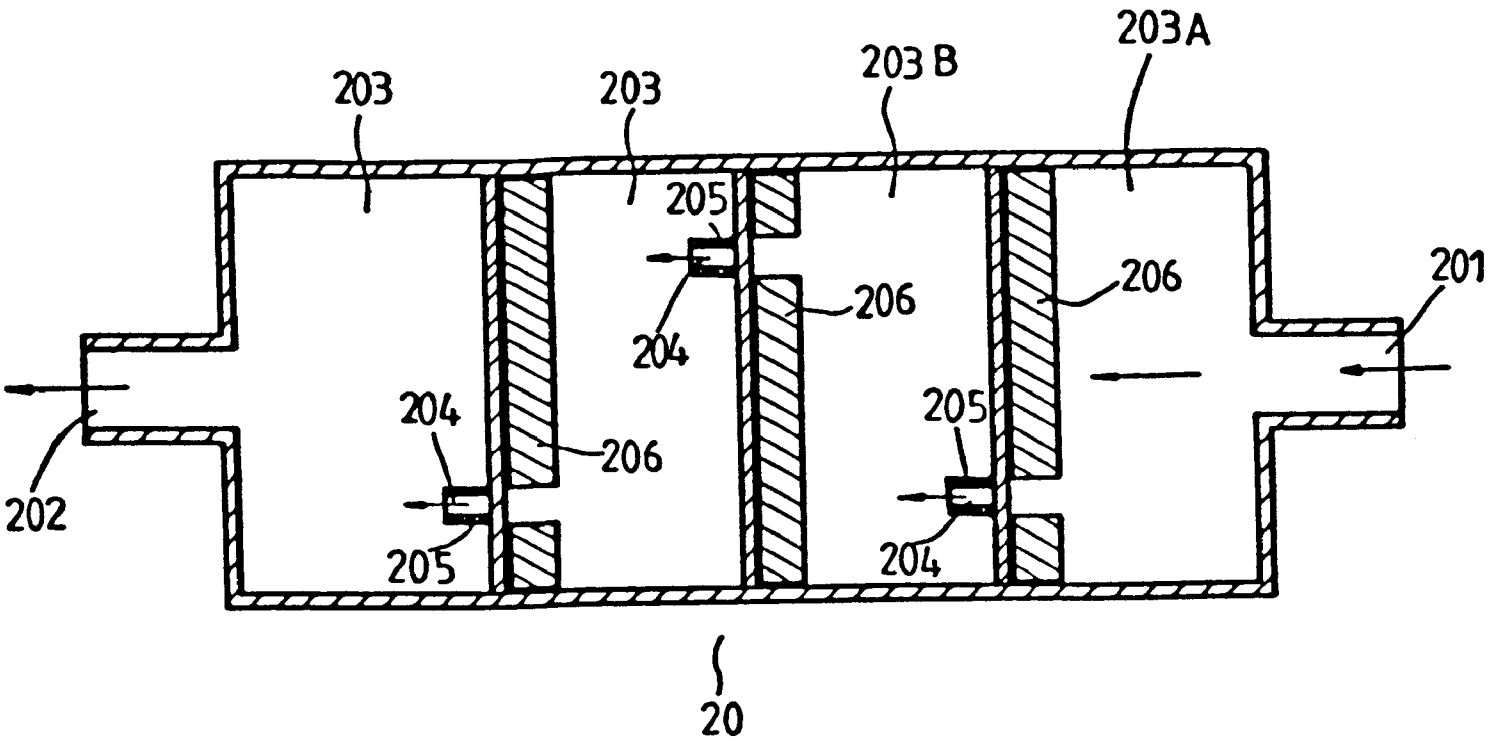
Fig. 3 PRIOR ART
FIG. 3 shows a schematic view of still another prior art muffler.
Figure 4:
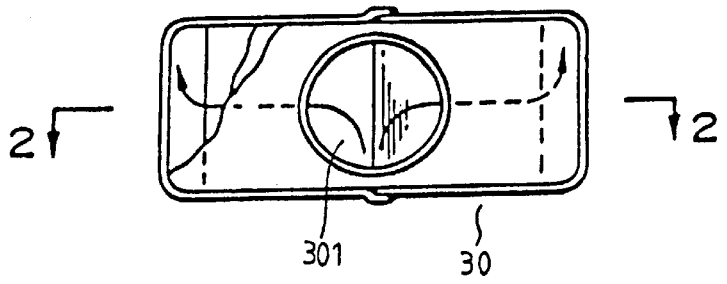
Fig. 4 PRIOR ART
FIG. 4 shows a side schematic view of an muffler disclosed in the U.S. Pat. No. 4,574,914.
Figure 5:
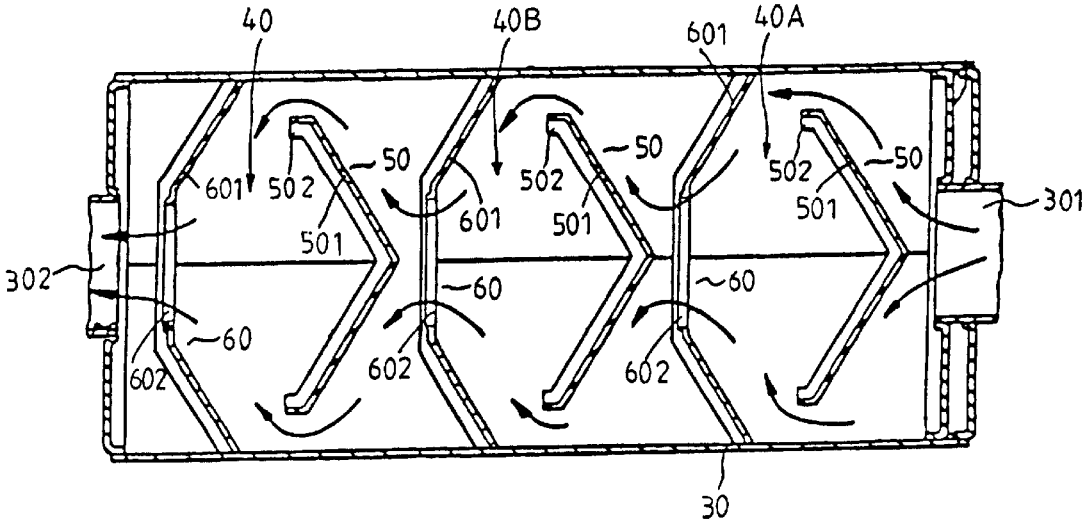
Fig. 5 PRIOR ART
FIG. 5 shows a sectional schematic view of the muffler as shown in FIG. 4.
Figure 6:
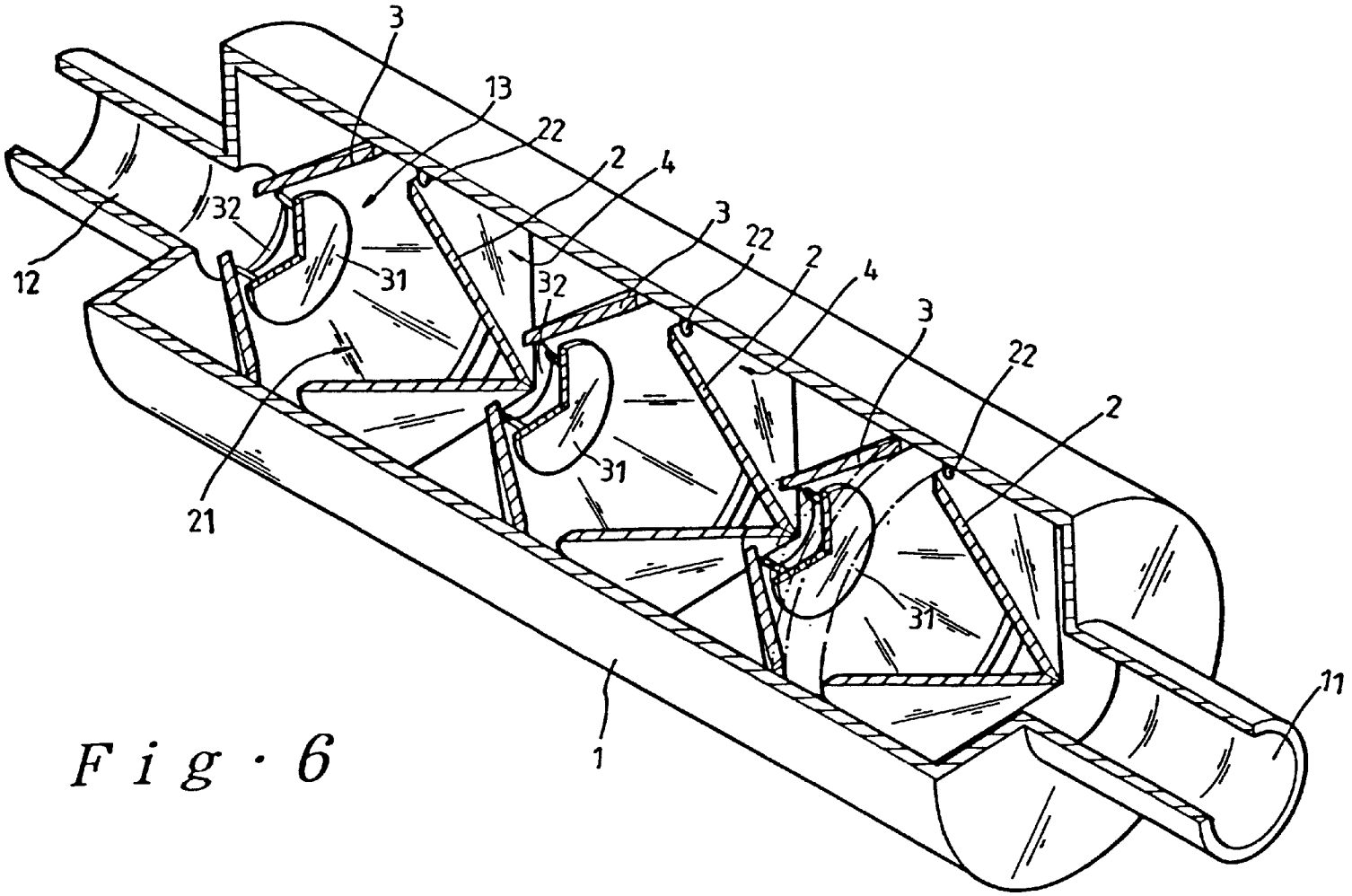
FIG. 6 shows a perspective view of the preferred embodiment of the present invention.

As shown in FIG. 6, a round muffler 1 embodied in the present invention is provided at both ends thereof with an inlet 11 and an outlet 12. The round muffler 1 is provided therein sequentially with three sets of air chambers 13 which are formed of a stop portion 2 and a tapered cylinder 3. The stop portion 2 is of a hollow tapered construction and is fastened with the air chamber 13 such that the stop portion 2 is contiguous to the inlet 11, and that an opening 21 of the stop portion 2 faces the outlet 12. The tapered cylinder 3 has a < shape and is separated from the stop portion 2 by an appropriate distance such that the tapered cylinder 3 is contiguous to the outlet 12. The tapered cylinder 3 is provided therein with a stop piece 31 fastened therewith. The tapered cylinder 3 is further provided in the wall of the apex thereof with a discharge hole 32.

The stop portion 2 is located in the wall of the round muffler 1 by a plurality of connection pillars 22. The outer wall of the tapered cylinder 3 is fastened with the wall of the round muffler 1.

Figure 7:
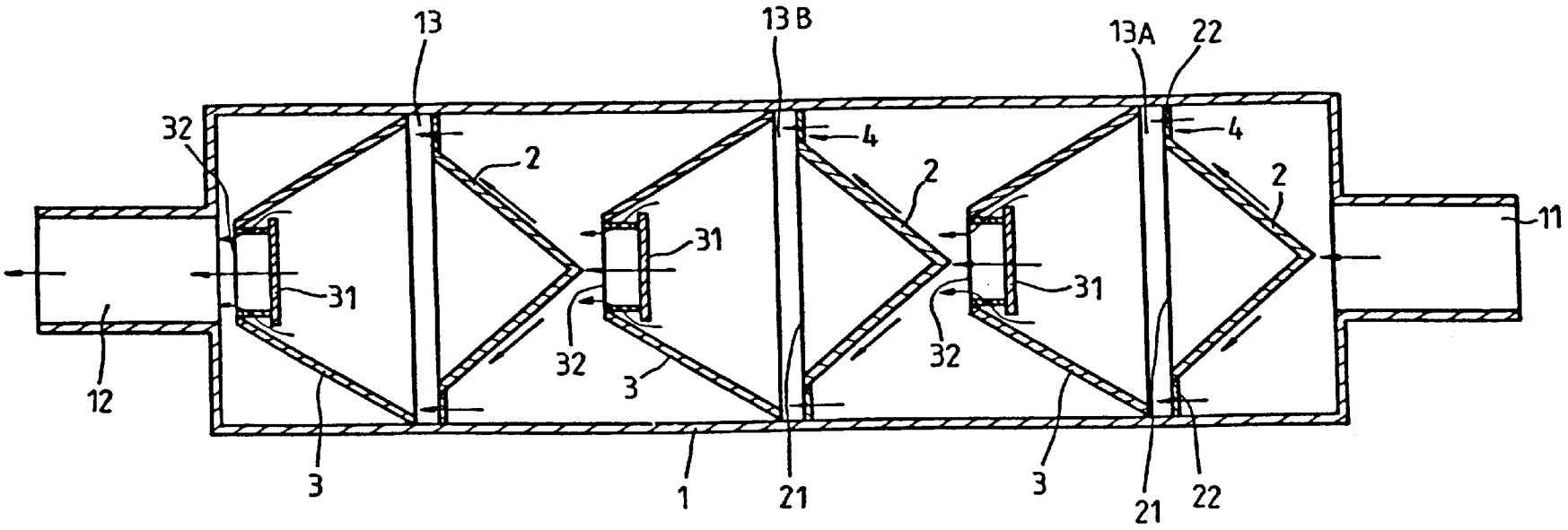
FIG. 7 shows a sectional schematic view of the preferred embodiment of the present invention.

As shown in FIG. 7, the stop portion 2 and the tapered cylinder 3 have a < shape and are opposite to each other. As a result, the round muffler 1 is separated by the stop portions 2 and the tapered cylinders 3 to form three sets of air chambers 13. In addition, the round muffler 1 is provided therein with a plurality of gas ducts 4 formed between the stop portions 2 and the round muffler 1.

Figure 8:
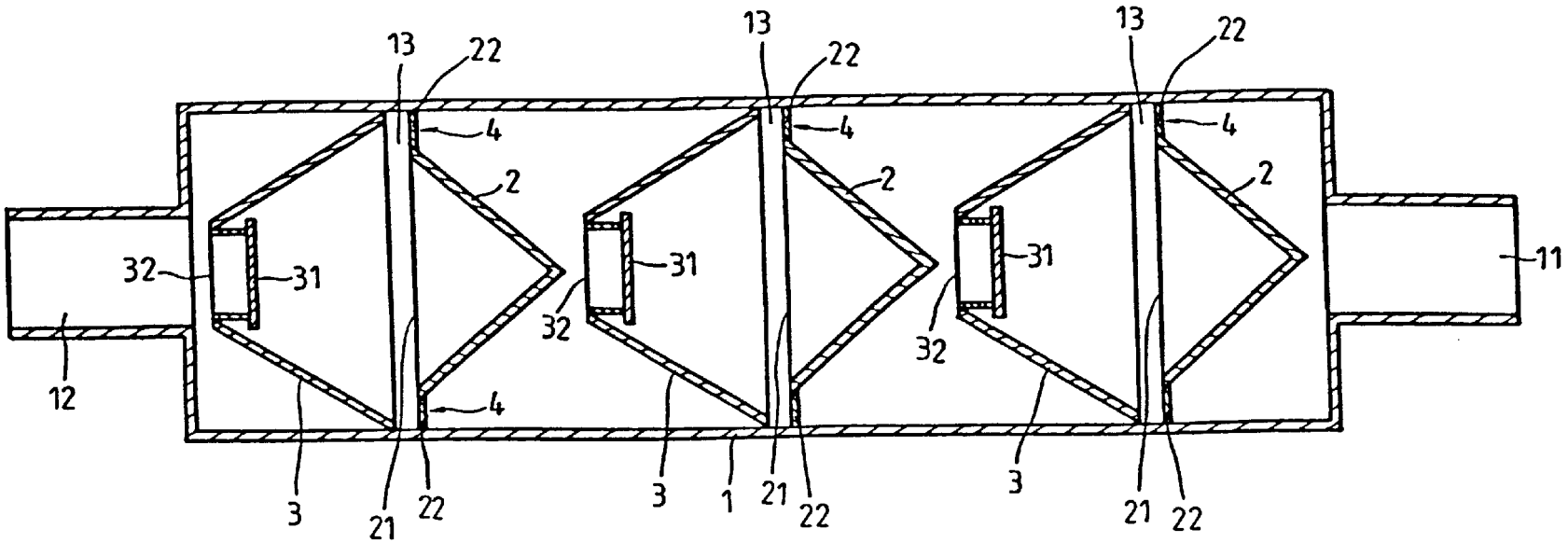
FIG. 8 shows a schematic view of the preferred embodiment of the present invention at work.

As shown in FIG. 8, when the exhaust fume produced by the engine enters the round muffler 1 via the inlet 11, the exhaust fume current is obstructed by the stop portion 2 such that the exhaust fume current enters the gas duct 4 located between the stop portion 2 and the muffler 1, and further that the exhaust fume current is obstructed by the tapered hollow body of the stop portion 2, the tapered cylinder 3 and the stop piece 31, so as to form a gas eddy current which circulates.

When the gas eddy current circulates and flows in the air chamber 13A formed of the tapered cylinder 3 and the stop portion 2, the gas noise of the exhaust fume is absorbed by the circulating eddy current. When the volume of the gas eddy current in the air chamber 13A has reached the saturation, the exhaust fume moves through the space located between the stop piece 31 and the tapered cylinder 3 into the discharge hole 32 located in the wall of the apex of the tapered cylinder 3. The exhaust fume is subsequently guided into another air chamber 13B such that the exhaust fume is once again obstructed by the stop portion 2, and that the exhaust fume enters another air chamber 13B via the gas duct 4, thereby resulting in another circulation of the exhaust fume. As the exhaust fume flows through sequentially the three sets of air chambers, the exhaust fume is emitted into the atmospheric air via the outlet 12 of the round muffler 1.

In light of the structure of the round muffler of the present invention is described above, the round muffler of the present invention is compatible with the motor vehicles having the round fastening hole. When the exhaust fume is emitted from the engine, the exhaust fume moves in quantity into the hollow tapered body of the stop portion via the gas duct located between the stop portion and the round muffler. As the exhaust fume enters the air chamber, the exhaust fume is obstructed by the stop portion and the tapered cylinder to form in the air chamber a strong gas eddy current capable of absorbing the gas noise of the exhaust fume. When the exhaust fume flows sequentially through the three sets of air chambers, the noise of the exhaust fume is deadened.

In addition, when the exhaust fume enters the air chambers, the exhaust fume is obstructed by the tapered cylinder and the partition such that the exhaust fume stays in the air chamber, and that the exhaust fume is then let out via the discharge hole of the tapered cylinder. As a result, the duration in which the exhaust fume stays in the round muffler is prolonged to an extent that the gas pressure in the air chamber is elevated to form the back pressure. In view of the fact that the exhaust fume is kept letting out via the discharge hole of the tapered cylinder, the value of the back pressure is kept in an appropriate range. During the interval between the two explosion timings of the cylinders, the back pressure serves to propel the gas mixture from the intake manifold into the combustion chamber of the cylinder.

The embodiment of the present invention described above is to be regarded in all respects as being merely illustrative and not restrictive. Accordingly, the present invention may be embodied in other specific forms without deviating from the spirit thereof The present invention is therefore to be limited only by the scopes of the following appended claims.

What is claimed is:

1. A cylindrically shaped muffler for a gas engine, comprising:

(a) a cylindrical shell having a shell-bore, an inlet and an outlet;

(b) a plurality of first hollow cones suspended within but is supported by said shell-bore, said first hollow cones having their largest diameters smaller than that of said shell-bore with their apexes pointing toward said inlet of said cylindrical shell;

(c) a plurality of hollow truncated second cones having their greatest diameters equal to that of said shell-bore in which they are supported in reverse to the first hollow cones and alternate therewith, so as to have their smallest diameter portions pointing toward said outlet of said cylindrical shell; and (d) a stopper suspended inside said hollow truncated second cone near its smallest diameter portion in such a manner to create eddy currents in gas flow and absorb noise.

2. The cylindrically shaped muffler for a gas engine according to claim 1, wherein said stopper is circular in shape having a diameter greater than said smallest diameter of said hollow truncated second cone.

3. The cylindrically shaped muffler for a gas engine according to claim 1, wherein said second truncated hollow cones are fastened to said cylindrical shell from outside of said cylindrical shell.

4. The cylindrically shaped muffler for a gas engine according to claim 1, wherein said first hollow cones are affixed to said shell-bore by a plurality of connection pillars.

5. The cylindrically shaped muffler for a gas engine according to claim 1, wherein said stopper is affixed to said smallest portion of said hollow second truncated cone by a plurality of connection pillars.

* * * * *